US010647482B1

(12) United States Patent
Pai

(10) Patent No.: US 10,647,482 B1
(45) Date of Patent: May 12, 2020

(54) CARTON WITH FASTENING STRUCTURE

(71) Applicant: DONGGUAN TAPUMEI PRINTING CO., LTD., Dongguan, Guang Dong (CN)

(72) Inventor: Hsuan-Hao Pai, Taichung (TW)

(73) Assignee: DONGGUAN TAPUMEI PRINTING CO., LTD., Dongguan, Guang Dong (CN)

( * ) Notice: Subject to any disclaimer, the term of this patent is extended or adjusted under 35 U.S.C. 154(b) by 0 days.

(21) Appl. No.: 16/179,300

(22) Filed: Nov. 2, 2018

(51) Int. Cl.

| | |
|---|---|
| ***B65D 50/04*** | (2006.01) |
| ***B65D 5/38*** | (2006.01) |
| ***B65D 55/04*** | (2006.01) |
| ***B65D 5/64*** | (2006.01) |

(52) U.S. Cl.
CPC ..... *B65D 50/04* (2013.01); *B65D 5/38* (2013.01); *B65D 5/643* (2013.01); *B65D 55/04* (2013.01); *B65D 2215/02* (2013.01)

(58) Field of Classification Search
CPC ..... B65D 5/38; B65D 5/643; B65D 50/04; B65D 55/04; B65D 2215/02; B65D 5/02; B65D 5/04; B65D 5/10; B65D 5/20; B65D 5/42; G08B 13/14
USPC ..... 206/1.5; 229/125.125
See application file for complete search history.

(56) References Cited

U.S. PATENT DOCUMENTS

| | | | | |
|---|---|---|---|---|
| 4,284,204 | A * | 8/1981 | Carey, Jr. | B65D 11/12 206/1.5 |
| 5,039,982 | A * | 8/1991 | Bruhwiler | E05B 73/0023 206/1.5 |
| 5,517,178 | A * | 5/1996 | Rodrigues | A47F 7/024 206/247 |
| 5,707,004 | A | 1/1998 | Cai | |
| 7,959,060 | B2 | 6/2011 | Wilson et al. | |
| 10,479,581 | B2 * | 11/2019 | Chambers | B65D 5/10 |
| 10,518,927 | B2 * | 12/2019 | Chambers | B65D 5/10 |

* cited by examiner

*Primary Examiner* — Bryon P Gehman
(74) *Attorney, Agent, or Firm* — Muncy, Geissler, Olds & Lowe, P.C.

(57) ABSTRACT

A carton with fastening structure includes an inner box including an inner case body, an outer case cover including an outer cover body sheltering inner case body, and an elastic fastening part fixed inside the inner case body. The outer cover body includes an opening providing the inner case body to slide in. The outer cover body slips relative to the inner case body to shelter the inner cover body at a closed position. The elastic fastening part includes a shifting part. Each of the outer cover body and the inner case body includes an outer through-hole and an inner through-hole, respectively. The shifting part includes a fastening position, where the shifting part passes through the outer through-hole and the inner through-hole when the outer cover body is at the closed position, and a retracted position, where the shifting part does not pass through the outer through-hole and the inner through-hole.

13 Claims, 7 Drawing Sheets

CARTON WITH FASTENING STRUCTURE

FIELD OF THE INVENTION

The present invention is related to a carton, particularly to a childproofing structure of carton.

BACKGROUND OF THE INVENTION

Cartons are commonly used for packing and preserving products, such as tobaccos and etc., due to environmentally-friendly, recyclable, elegant, water vapor absorbing features and so on. For example, U.S. Pat. No. 5,707,004 "CARTON WITH OFFSET LOCK" and U.S. Pat. No. 7,959,060 B2 "MULTI-PLY CARTON HAVING RECLOSABLE OPENING FEATURE" disclose two types of cartons with different structures and are used for depositing articles, such as tobaccos, foodstuffs and etc.

In each of the two conventional types of carton structure, a reclosable lid and a latch blocking the lid are designed, respectively, for the reusability of the carton. Thereby, the lid being opened at will due to gravity or inertial force is avoided. The purpose of the latch as described above is only fixation of the lid. For children, especially children of younger age, the lid is still opened by exerting children's strength, because unblocking the latch and opening the lid are emerged in the same direction. That is, the conventional carton structure didn't have a preventive effect upon being unintentionally opened by children. In other words, it is possible for children to open the carton by themselves when adults are inattentive. If the carton is used for storing articles unsuitable for children, such as tobaccos the risks of mistaking by children are resulted.

SUMMARY OF THE INVENTION

It is the main object of the present invention to provide a child safety lock structure of carton, capable of preventing unintentionally opening of the carton so as to avoid the risk of misswallowing by children.

For achieving the above object, the present invention provides a carton with fastening structure including an inner box, an outer case cover, and an elastic fastening part, wherein the inner box is provided with an inner case body extending axially, the outer case cover is provided with an outer cover body sheltering the inner case body, the outer cover body is provided with an opening providing the inner case body to slide, and the outer cover body is provided with a closed position sheltering the inner case body completely through slippage relative to the inner case body. The elastic fastening part is provided with a shifting part. The elastic fastening part is fixed inside the inner case body, while the outer cover body and the inner case body are provided with an outer through-hole and an inner through-hole, respectively and correspondingly. Moreover, the shifting part is provided with a fastening position, which the shifting part passes through the outer through-hole and the inner through-hole when the outer cover body is situated at the closed position, and the shifting part is provided with a retracted position, which the shifting part without passes through the outer through-hole and the inner through-hole.

Thereby, the present invention is directed to a child safety lock of a carton formed by the shifting part passing through the outer through-hole as well as the inner through-hole and then the shifting part fastening on the outer cover body to avoid the carton being opened by children easily. Furthermore, when adults require opening the carton, the shifting part is pressed inwardly to retract the shifting part to be situated at the retracted position, and the outer cover body is then slipped relatively to the inner case body to be opened.

DETAILED DESCRIPTION OF THE PREFERRED EMBODIMENTS

The detailed description and technical content of the present invention will now be described, in conjunction with drawings, as follows.

Figure 1:
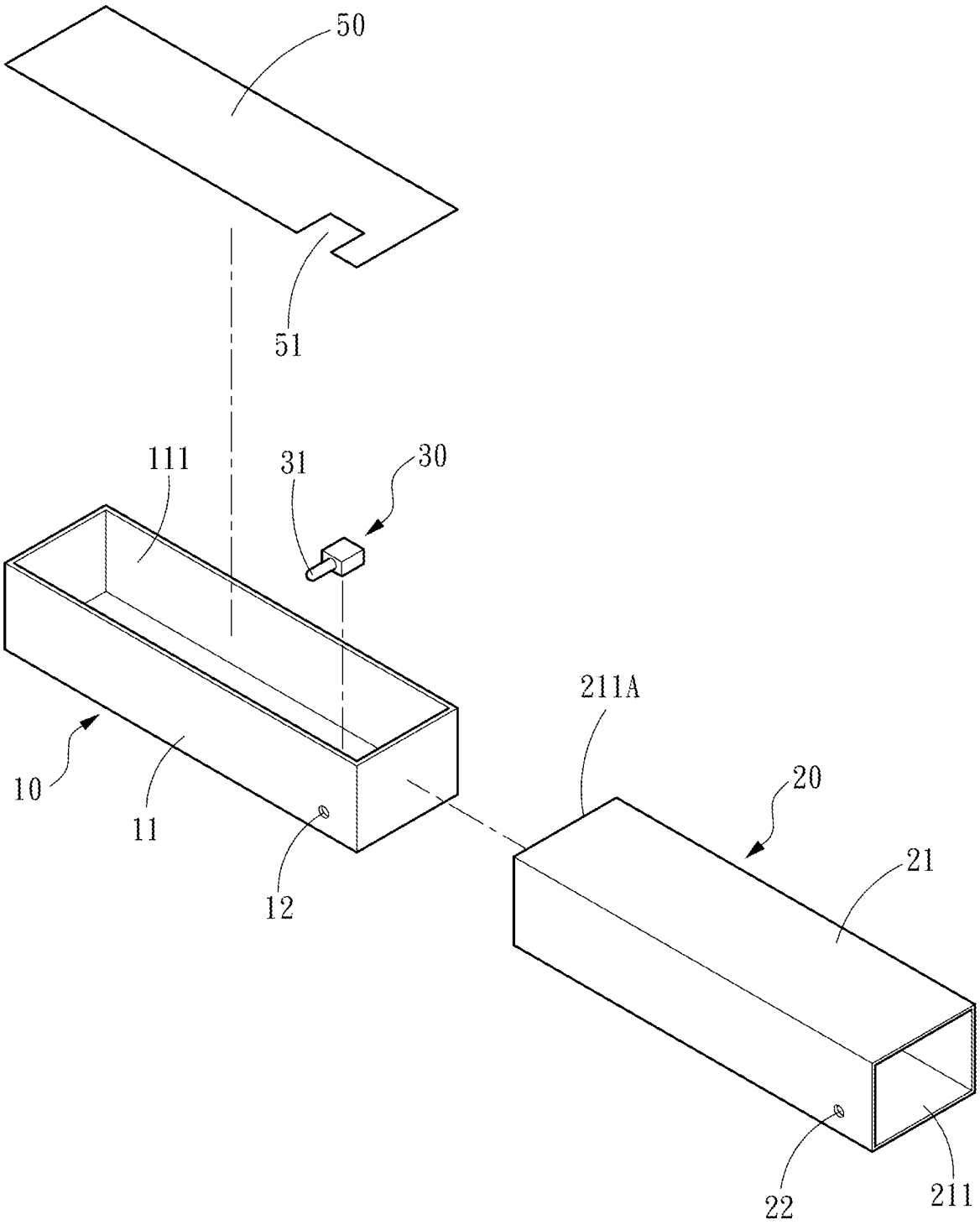
FIG. 1 is a structural disassembled view of a first embodiment of the present invention.
Figure 2:
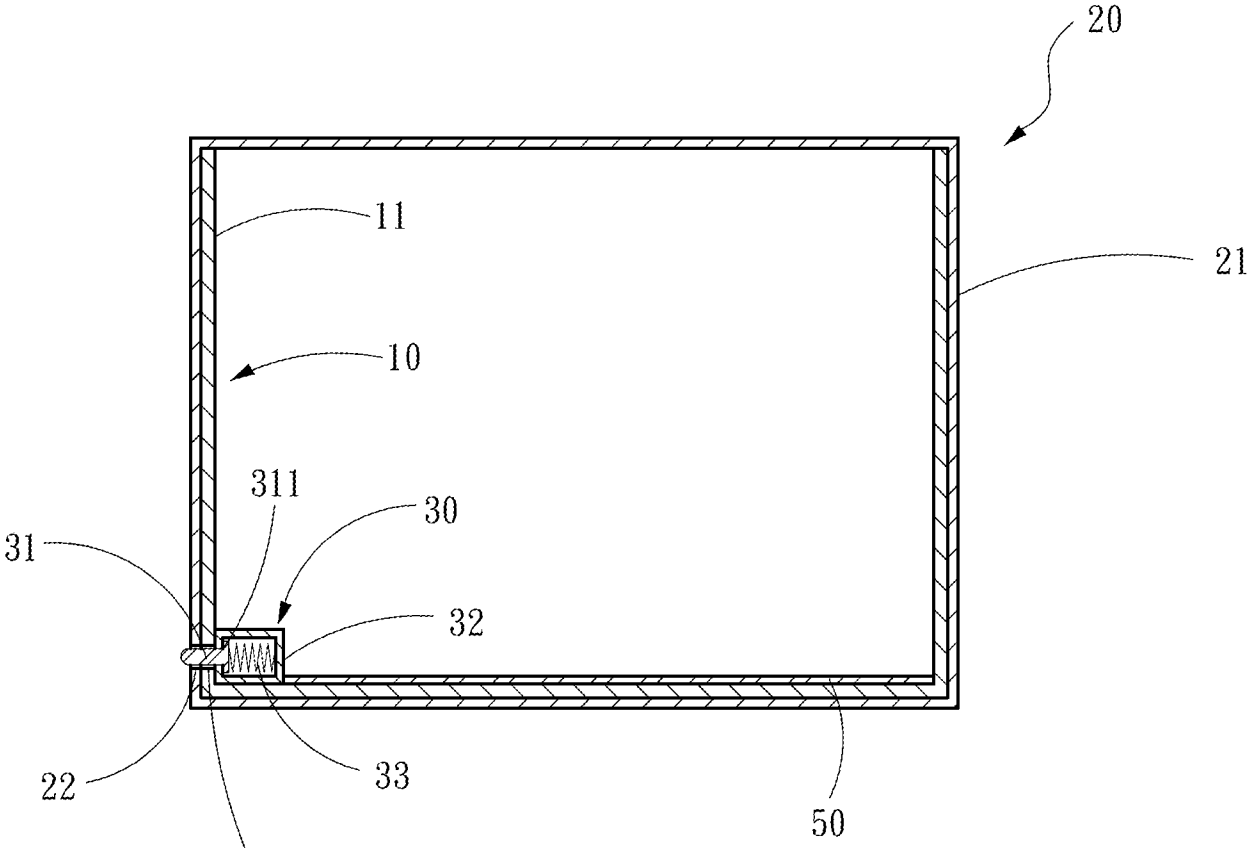
FIG. 2 is a structural assembled cross-sectional view of the first embodiment of the present invention.
Figure 3:
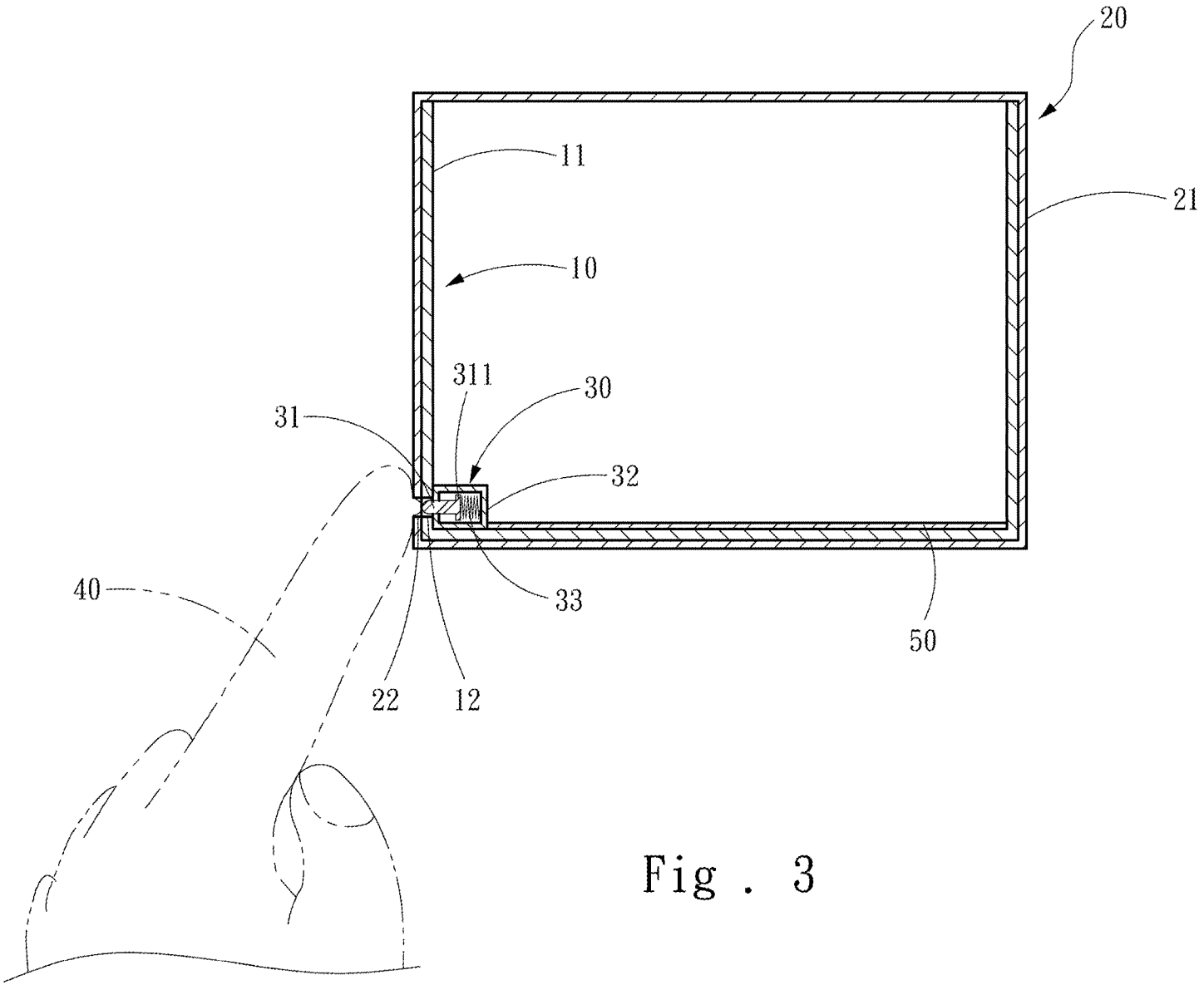
FIG. 3 is an unlocking diagram of the first embodiment of the present invention.

Referring to FIGS. 1, 2 and 3, the present invention is a carton with fastening structure including an inner box 10, an outer case cover 20, and an elastic fastening part 30. The inner box 10 is provided with an inner case body 11 extending axially, and the inner case body 11 may be a rectangular body and includes a retrieval opening 111 faced upward. The inner case body 11 is provided for a user to store articles therein.

The outer case cover 20 is provided with an outer cover body 21 sheltering the inner case body 11. The outer cover body 21 is provided with an opening 211, which provides the inner case body 11 to slide into the outer cover body 21, and the outer cover body 21 is provided with a closed position sheltering the inner case body 11 completely through slippage relative to the inner case body 11. For the enhancement of diversity and convenience in operation, the outer cover body 21 further comprises another opening 211A disposed at two sides of the outer case cover 20, respectively, in such a way that the user is able to force the inner case body 11 from any one of the openings 211, 211A to enable the movement and then disengagement of the inner case body 11 relative to the outer cover body 21.

The elastic fastening part 30 is provided with a shifting part 31. The elastic fastening part 30 is fixed inside the inner case body 11, while the outer cover body 21 and the inner case body 11 are respectively provided with an outer through-hole 22 and an inner through-hole 12. Moreover, the shifting part 31 is provided with a fastening position, which the shifting part 31 passes through the outer through-hole 22 and the inner through-hole 12 when the outer cover body 21 is situated at the closed position (as illustrated in FIG. 2). Further, the shifting part 31 is provided with a retracted position, which the shifting part 31 without passes through the outer through-hole 22 and the inner through-hole 12 (as illustrated in FIG. 3). For the prevention of disengagement and shifting of the elastic fastening part 30, additionally, the present invention further includes an auxiliary fixing plate 50, the auxiliary fixing plate 50 being fixed inside the inner case body 11 and being provided with a notch 51 connecting with the elastic fastening part 30 to fix the elastic fastening part 30 through the notch 51.

In practice, the elastic fastening part 30 further includes a fixing part 32 and a spring 33. The shifting part 31 is penetrated into the fixing part 32, and the shifting part 31 is provided with a fastening edge 311 fastened inside the fixing part 32. Furthermore, the spring 33 is disposed in the fixing part 32 and the spring 33 presses the shifting part 31 to move outwardly up to the fastening position. Additionally, the outer through-hole 22 and the inner through-hole 12 are disposed on one side of the outer cover body 21 and one side of the inner case body 11, respectively.

Referring to FIG. 3, a child safety lock of the carton is in an effective state without being opened by children easily, when the shifting part 31 is fastened to the outer cover body 21 by passing through the outer through-hole 22 and the inner through-hole 12 (as illustrated in FIG. 2). Furthermore, when the child safety lock is unlocked as desired, the shifting part 31 is pressed by a hand 40 of the user to retract the shifting part 31 to the retracted position. At the moment, the shifting part 31 does not pass through the outer through-hole 22 and doesn't fasten the outer cover body 21 any longer. Thereby, the inner case body 11 is able to be forced by the user to move relatively to the outer cover body 21, such that the retrieval opening 111 of the inner case body 11 is opened.

Figure 4:
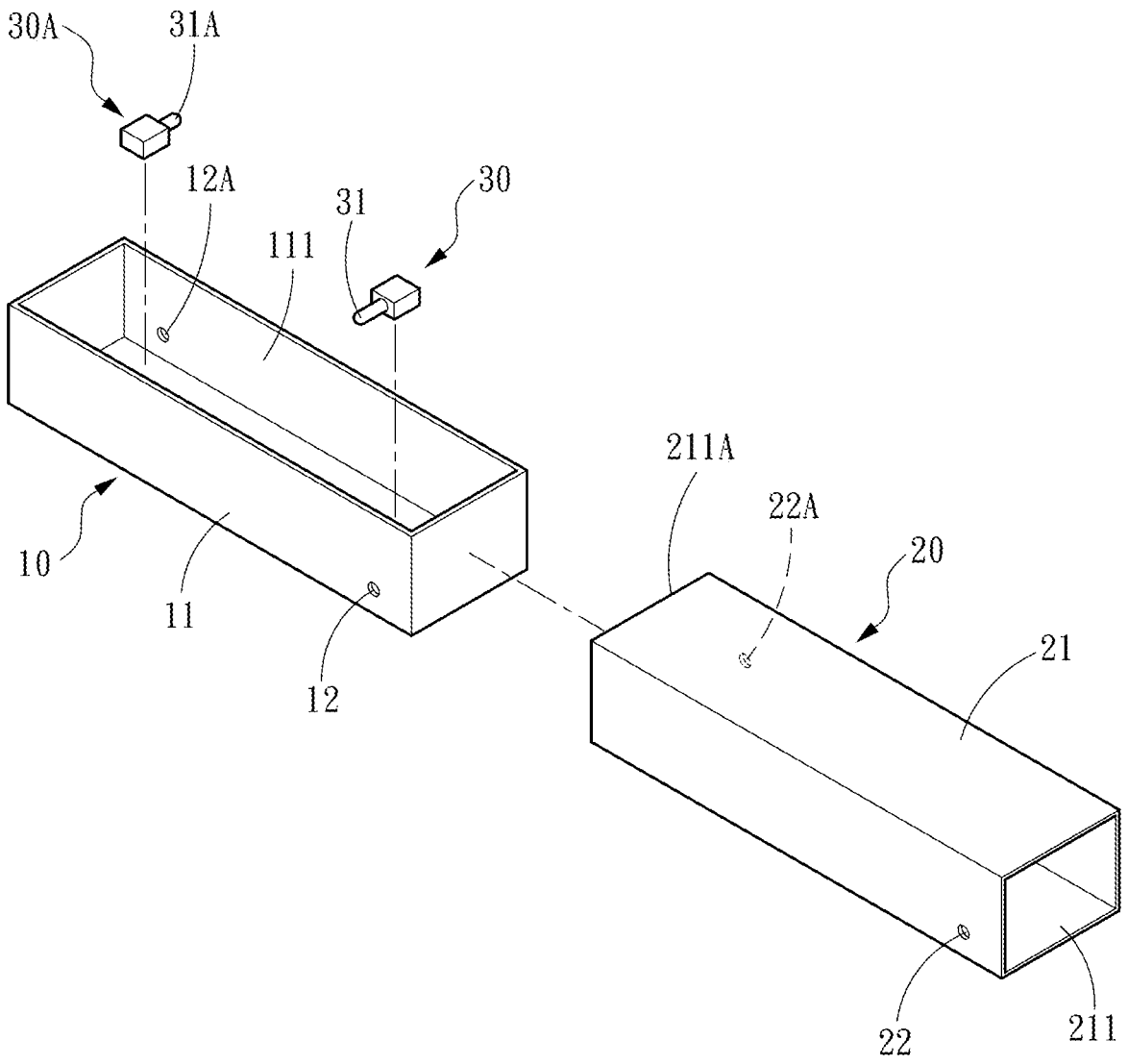
FIG. 4 is a structural disassembled view of a second embodiment of the present invention.

Referring to FIG. 4, there is shown a second embodiment of the present invention. As illustrated in FIG. 4, the present invention further comprises another elastic fastening part 30A including another shifting part 31A, another outer through-hole 22A, and another inner through-hole 12A. Additionally, the two outer through-holes 22, 22A are disposed on two diagonal sides of the outer cover body 21, while the two inner through-holes 12, 12A are disposed on two diagonal sides of the inner case body 11. Furthermore, the two elastic fastening parts 30, 30A are disposed in correspondence with positions of the two outer through-holes 22, 22A and the two inner through-holes 12, 12A to form two sets of child safety locks. It is necessary for the user to press the two shifting parts 31, 31A of the two elastic fastening parts 30, 30A by the hand 40 at the same time to unlock the two shifting parts 31, 31A completely. Thus, being unintentionally opened by children is avoided assuredly.

Figure 5:
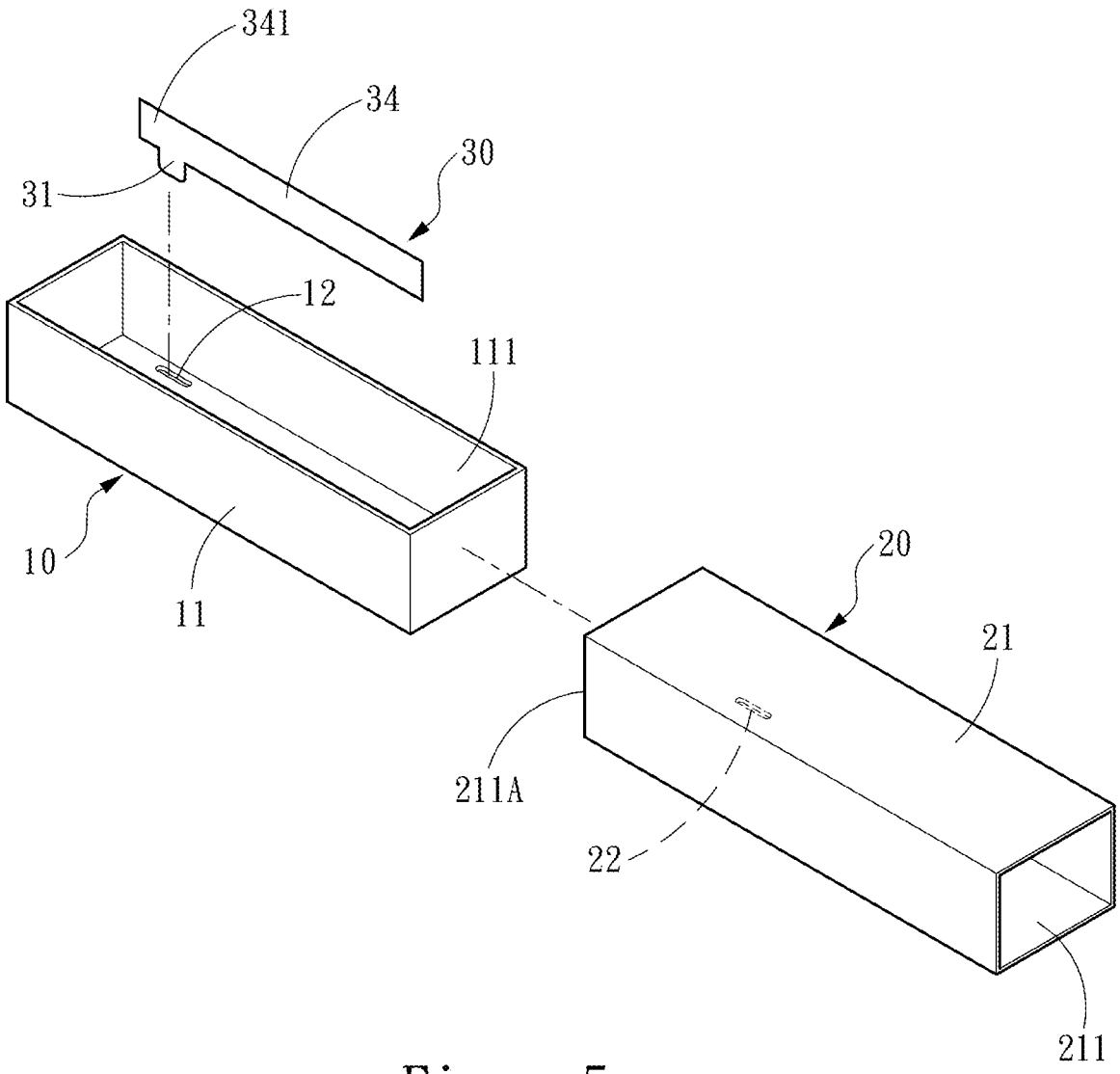
FIG. 5 is a structural disassembled view of a third embodiment of the present invention.

Referring to FIG. 5 further, there is shown a third embodiment of the present invention. As illustrated in FIG. 5, the elastic fastening part 30 is a flexible plate body 34. One end of the plate body 34 is a fixing end 341 disposed inside the inner case body 11, and another end of the plate body 34 far away from the fixing end 341 is provided with the shifting part 31. Additionally, the outer through-hole 22 and the inner through-hole 12 are disposed on a bottom of the outer cover body 21 and the inner case body 11, respectively. When the shifting part 31 is pressed by the user, the plate body 34 is flexed due to elasticity of the plate body 34, such that the shifting part 31 is retracted to the retracted position.

Figure 6:
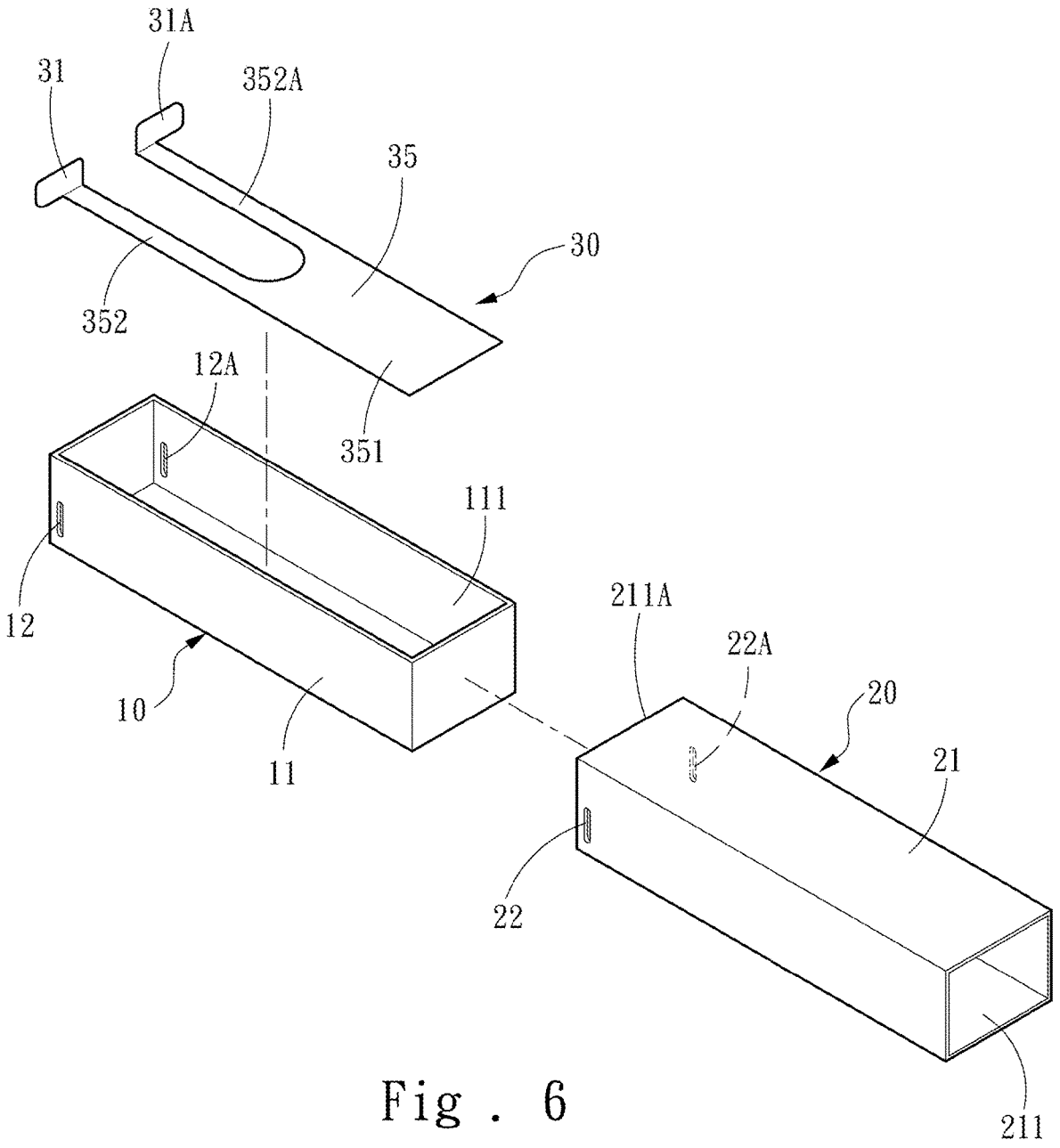
FIG. 6 is a structural disassembled view of a fourth embodiment of the present invention.

Referring to FIG. 6 further, there is shown a fourth embodiment of the present invention. As illustrated in FIG. 6, the present invention comprises another shifting part 31A, another outer through-hole 22A, and another inner through-hole 12A. Additionally, the elastic fastening part 30 is a flexible U-shaped plate body 35. Two ends of U-shaped plate body 35 respectively include a first end 351 and two second ends 352, 352A. The two second ends 352, 352A are bifurcated to each other, the two shifting parts 31, 31A are respectively extended from the two second ends 352, 352A, and the first end 351 is fixed inside the inner case body 11. Further, the two outer through-holes 22, 22A are disposed on two sides of the outer cover body 21, 21A, while the two inner through-holes 12, 12A are disposed on two sides of the inner case body 11, respectively. Similarly, when the two shifting parts 31 is pressed by the user, the U-shaped plate body 35 is flexed due to elasticity of the U-shaped plate body 35, such that the two shifting parts 31, 31A is retracted to the retracted position.

Figure 7:
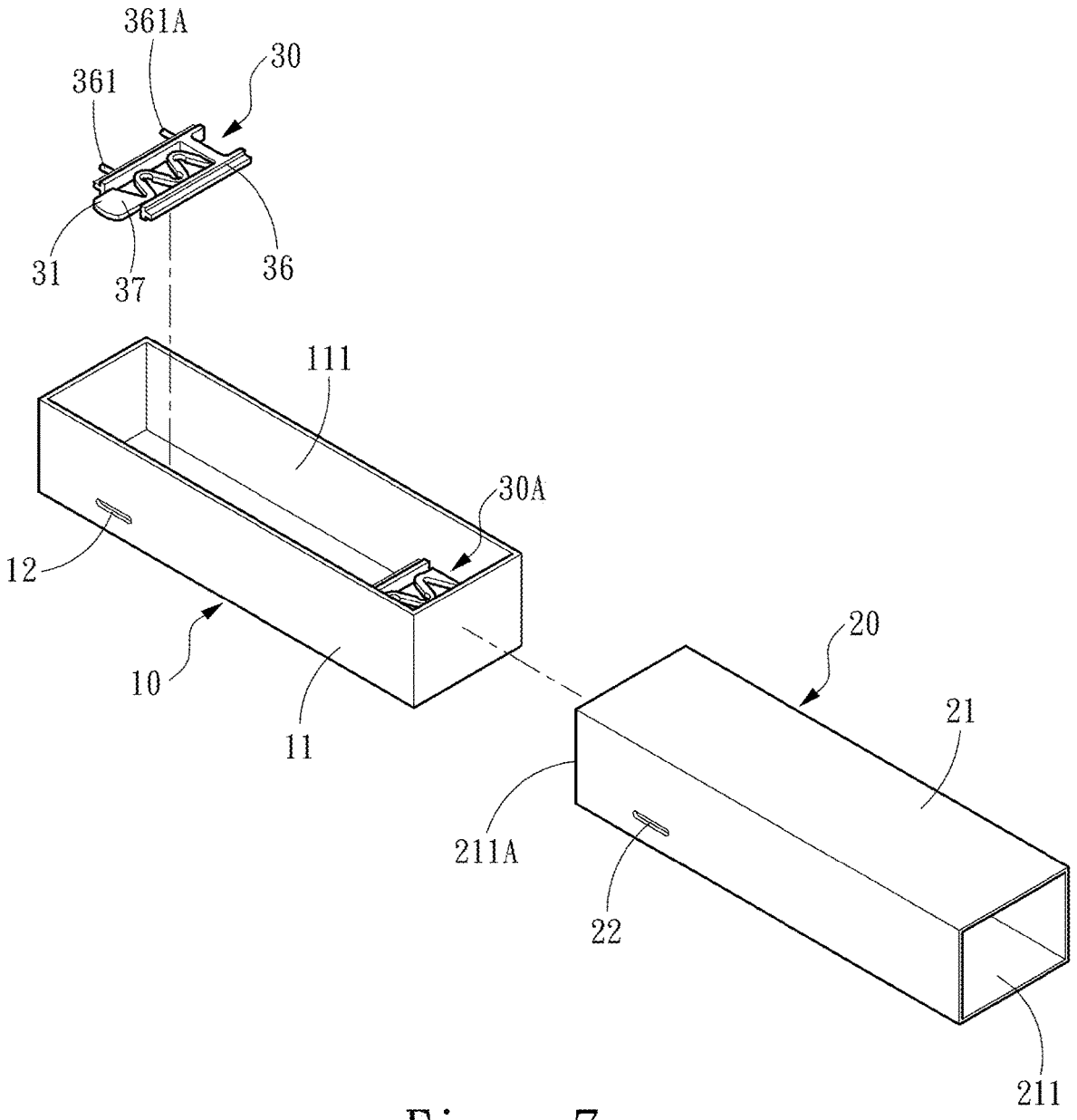
FIG. 7 is a structural disassembled view of a fifth embodiment of the present invention.

Referring to FIG. 7 further, there is shown a fifth embodiment of the present invention. As illustrated in FIG. 7, the elastic fastening part 30 is provided with a square frame body 36. The square frame body 36 is disposed at a bottom of the inner case body 11, and the square frame body 36 is snapped on inner walls of the inner case body 11. In order to position the square frame body 36, the square frame body 36 includes two fixing posts 361, 361A extending outward from the square frame body 36. The two fixing posts 361, 361A are provided to be snapped on the inner walls of the inner case body 11 to position the square frame body 36 quickly.

The square frame body 36 is provided with an S rod 37 repeatedly bended. The S rod 37 is provided at one end thereof with the shifting part 31. Additionally, the outer through-hole 22 and the inner through-hole 12 are corresponded to the shifting part 31, and are disposed on the same sides of the outer cover body 21 and the inner case body 11. When the shifting part 31 is compressed by the user, the S rod 37 is contracted due to elasticity of the S rod 37, such that the shifting part 31 is retracted to the retracted position. For the enhancement of comfort in operation, the end of the S rod 37 (i.e., the shifting part 31) is in form of an arc to avoid stabbing the user. Besides, as with the fourth embodiment, the present invention further comprises another elastic fastening part 30A to form two sets of child safety locks for avoiding assuredly from being unintentionally opened by children.

To sum up, the present invention provides a carton with fastening structure. There are merits, as compared to the prior art, at least including:

1. A child safety lock of a carton is formed by the shifting part passing through the outer through-hole as well as the inner through-hole and then the shifting part fastening on the outer cover body to avoid the carton being opened by children easily. Furthermore, when adults require opening the carton, the shifting part is pressed inwardly to retract the shifting part to the retracted position for releasing the child safety lock, and the outer cover body is then slipped relatively to the inner case body to be opened.

2. The carton is able to comprise the two elastic fastening parts at different positions corresponding to the two outer through-holes and the two inner through-holes to form multiple child safety locks. Thus, being unintentionally opened by children may be avoided.

What is claimed is:

1. A carton with fastening structure, comprising:

an inner box, including an inner case body;

an outer case cover, including an outer cover body sheltering said inner case body, said outer cover body including an opening, provided for said inner case body to slide in, and said outer cover body slipping relative to said inner case body to shelter said inner case body at a closed position; and an elastic fastening part, including a shifting part and fixed inside said inner case body, while said outer cover body and said inner case body respectively including an outer through-hole and an inner through-hole correspondingly to said elastic fastening part, when said outer cover body is at said closed position, said shifting part comprising a fastening position and a retracted position wherein said shifting part passes through the inner through-hole of said inner case body and the outer through-hole of said outer case body at said fastening position; and wherein said shifting part does not pass through said inner through-hole of said inner case body and said outer through-hole of said outer case body at said retracted position.

2. The carton with fastening structure according to claim 1, wherein said inner case body is a rectangular body, and said inner case body is provided with a retrieval opening faced upward.

3. The carton with fastening structure according to claim 1, wherein said outer cover body further comprises another opening, and said two openings are disposed on two sides of said outer case cover, respectively.

4. The carton with fastening structure according to claim 1, wherein said elastic fastening part further comprises a fixing part and a spring, said shifting part is penetrated into said fixing part, and said shifting part includes a fastening edge fastened inside said fixing part, said spring is further disposed in said fixing part for pressing said shifting part to move outwardly up to said fastening position.

5. The carton with fastening structure according to claim 4, wherein said outer through-hole and said inner through-hole are disposed on one side of said outer cover body and one side of said inner case body, respectively.

6. The carton with fastening structure according to claim 4, further comprising another elastic fastening part, another outer through-hole, and another inner through-hole, and said two outer through-holes disposed on two diagonal sides of said outer cover body, said two inner through-holes disposed on two diagonal sides of said inner case body, and said two elastic fastening parts disposed in correspondence with positions of said two outer through-holes and said two inner through-holes.

7. The carton with fastening structure according to claim 1, wherein said elastic fastening part is a flexible plate body, one end of said plate body includes a fixing end disposed inside said inner case body, another end of said plate body far away from said fixing end is provided with said shifting part.

8. The carton with fastening structure according to claim 7, wherein said outer through-hole and said inner through-hole are disposed on a bottom of said outer cover body and said inner case body, respectively.

9. The carton with fastening structure according to claim 1, further comprising another shifting part, another outer through-hole, and another inner through-hole, wherein said elastic fastening part is a flexible U-shaped plate body, two ends of said U-shaped plate body respectively comprise a first end and two second ends, said two second ends are bifurcated to each other, said two shifting parts are respectively extended from said two second ends, said first end is fixed inside said inner case body, said two outer through-holes are respectively disposed on two sides of said outer cover body, and said two inner through-holes are respectively disposed on two sides of said inner case body.

10. The carton with fastening structure according to claim 1, further comprising an auxiliary fixing plate, said auxiliary fixing plate fixed inside said inner case body and said auxiliary fixing plate including a notch connecting with said elastic fastening part to fix said elastic fastening part through said notch.

11. The carton with fastening structure according to claim 1, wherein said elastic fastening part includes a square frame body, said square frame body is snapped on inner walls of said inner case body and disposed at a bottom of said inner case body, said square frame body includes an S rod repeatedly bended, said S rod being provided at one end thereof with said shifting part, and said outer through-hole and said inner through-hole corresponding to said shifting part are disposed on the same sides of said outer cover body and said inner case body.

12. The carton with fastening structure according to claim 11, wherein said square frame body includes two fixing posts extended outward from said square frame body, and said two fixing posts are snapped on the inner walls of said inner case body.

13. The carton with fastening structure according to claim 11, wherein end of said S rod is in form of an arc.

* * * * *